US005452851A

United States Patent [19]

Albert et al.

[11] Patent Number: 5,452,851

[45] Date of Patent: Sep. 26, 1995

[54] TWO-SHEET SELF-MAILER

[75] Inventors: Dennis A. Albert, Milpitas; Joseph T. Mauss, Los Altos, both of Calif.

[73] Assignee: GlueFold, Inc., Newark, Calif.

[21] Appl. No.: 11,322

[22] Filed: Jan. 29, 1993

[51] Int. Cl.[6] ..... B65D 27/06; B65D 27/14

[52] U.S. Cl. ..... 229/301; 229/75; 229/305

[58] Field of Search ..... 229/301, 305, 229/306, 69, 75

[56] References Cited

U.S. PATENT DOCUMENTS

| | | | |
|---|---|---|---|
| 1,089,486 | 3/1914 | Levine | 229/305 |
| 1,762,084 | 6/1930 | Snyder | 229/306 X |
| 2,722,369 | 11/1955 | Reuter | 229/69 |
| 2,759,658 | 8/1956 | Sawdon | 229/305 |
| 2,776,085 | 1/1957 | Furey | 229/69 |
| 2,777,631 | 1/1957 | Zalkind | 229/301 X |
| 2,847,235 | 8/1958 | Blumenthal | 229/306 X |
| 2,907,514 | 10/1959 | Bermingham, Jr. et al. | 229/306 |
| 3,131,854 | 5/1964 | Deutschmeister | 229/305 |
| 3,411,699 | 11/1968 | Pine et al. | 229/69 |
| 3,482,763 | 12/1969 | Carrigan | 220/69 |
| 3,497,132 | 2/1970 | Henry | 229/69 X |
| 4,313,557 | 2/1982 | Foffel | 229/301 X |
| 4,411,643 | 10/1983 | Higginson | 229/301 X |
| 4,889,278 | 12/1989 | Steidinger | 229/301 X |
| 4,927,072 | 5/1990 | Jenkins et al. | 229/69 X |
| 4,944,450 | 7/1990 | Schmidt | 229/301 |
| 5,011,069 | 4/1991 | Bowen et al. | 229/69 |
| 5,104,036 | 4/1992 | Rutkowski et al. | 229/301 |
| 5,118,030 | 6/1992 | McNamara et al. | 229/305 X |

FOREIGN PATENT DOCUMENTS

| | | | |
|---|---|---|---|
| 354758 | 2/1990 | European Pat. Off. | 229/301 |
| 2517633 | 6/1983 | France | 229/301 |
| 921378 | 3/1963 | United Kingdom | 229/69 |

*Primary Examiner*—Sue A. Weaver
*Attorney, Agent, or Firm*—Donald R. Boys

[57] ABSTRACT

A two-sheet self mailer with a return envelope is formed from a blank comprising two sheets joined around three sides with a remoistenable glue strip across the width of one of the sheets on the side enclosed by joining the two sheets to form the blank. The enclosure of the remoistenable glue strip, which forms the sealable flap of a return envelope for the mailer, avoids exposure of the remoistenable glue to excessive heat from fusion printing. A flap at one end of the blank formed as a result of one of the sheets comprising the blank being shorter than the other, allows the mailer to be fully sealed leaving no loose edge.

8 Claims, 11 Drawing Sheets

TWO-SHEET SELF-MAILER

FIELD OF THE INVENTION

The present invention is in the area of pre-printed mass mailers, and has particular application to such mailers designed for handling by automatic equipment in processing, and for providing sheets and envelopes to be returned by a recipient.

BACKGROUND OF THE INVENTION

In commercial operations where very large numbers of similar documents must be produced and mailed, a very small savings per document will translate into a large saving over the many documents. Examples of such documents are payroll checks, direct mail solicitations, 1099 forms, invoices, business statements, coupons, sales pieces, student grade reports, membership notices, and so forth. There are many other examples.

Traditional expenses for such operations include the cost of printing the documents, and labor for such tasks as folding, stuffing envelopes, and addressing. Another large and unavoidable expense is the postage to be paid for such mailings. In recent years, with the advent of equipment suitable for automatic handling of pieces of mail, it has become possible for the U.S. Post Office to offer discounts for bulk mailings that conform to certain standards for handling by automatic equipment. Among the standards are quite naturally certain size restrictions, and restrictions to loose edges and flaps which might jam the equipment. For bulk mail that conforms to the standards, Post Net Bar Codes are used in the processing.

Also in recent years, especially with the rapid growth of computer control techniques, equipment has been developed to produce self-mailers. This process takes a single sheet or a starting form comprising more than one sheet, and folds the form in concert with an application of adhesive (or activation of existing areas of adhesive), perforates the edges for ease of opening, and seals the form into a unit known in the art as a self-mailer. The self-mailer becomes or contains its own envelope, and no stuffing of envelopes is needed.

There are a number of different types of self-mailers known in the art and a number of different procedures for making them. For example, a type of adhesive that may later be activated with water (remoistenable adhesive) may be applied to forms, which are then fed automatically through a laser printer, and then to a folding and gluing machine that moistens the adhesive strips, folds the sheets, perforates the sheets appropriately for the particular form, and seals the unit together as a self-mailer. Remoistenable adhesive is the type used for flaps of most envelopes, and thus is familiar to most everyone.

Remoistenable glue has been a problem for forms that require printing, because laser-type printers have emerged as the state-of-the-art devices for speedy and economical printing. Remoistenable adhesives have not been tolerant of the heat required for fusion-type printers, which includes laser printers. The glue melts or partially melts and often jams the printers.

What is clearly needed in the art is a self-mailer, and a form for making a self-mailer, that results in a convenient return envelope with a pre-printed address, a convenient statement form, preferably presentable in parts for a user's own records and for a return form, a means of printing variable information during the printing and forming process, and a means of using remoistenable glue in the self-mailer without a danger of affecting fusion printers, all while producing a final product that meets the requirements for automatic handling. Such a mailer provides a considerable saving to the user/sender and a convenience to the recipient.

SUMMARY OF THE INVENTION

In a preferred embodiment a blank for making a two-sheet self mailer is provided comprising two substantially rectangular sheets of paper stock having a common end width and different length of side, juxtaposed and joined evenly at one end and along two sides by adhesive, leaving an extension flap of the longer sheet at the unjoined end. When the blank is folded twice to make a mailer, the flap extension allows the outside sheet to be glued down to the body of the mailer, leaving no loose edge.

In the two-sheet mailer a return envelope is formed by gluing the sides of the two sheets that form the blank with glue strips of two widths and perforating the folded and glued mailer at a distance from the outside edges less than the wider of the two widths, which leaves the edges of the return envelope portion joined after the mailer is opened. Remoistenable glue to make a sealable flap for the return envelope is applied across the width of one of the sheets of the blank on the side of the sheet that is within the enclosure formed by joining the two sheets. This positioning of the remoistenable glue strip protects the glue strip from heat from fusers when passing the blank through a laser printer. The resulting mailer is fully sealed and fit for handling by automatic postal equipment at reduced rates.

DESCRIPTION OF THE PREFERRED EMBODIMENTS

It is known to the present inventors to use two pre-glued-together sheets as a blank to form a self-mailer with an envelope having a remoistenable glue strip on the envelope flap. This arrangement avoids the danger of jamming or damaging fusion printers. The two sheets are glued together, typically before printing, in a way that has the remoistenable glue-strip between the sheets. When the two-sheet blank is passed through the fusion printer then, the remoistenable strip is "inside", and not exposed directly to the heat of the printer fusion device.

Another advantage of a two-sheet self-mailer is that it provides "extra" surfaces for printing, allowing for invoices, statements, notices, and the like, difficult if not impossible to provide with a single sheet mailer. These forms may be conveniently and advantageously printed on duplex-printers, such as the Model 4050 made by Xerox Corporation. These and other details are fully revealed in detailed descriptions of embodiments of the present invention below.

Figure 1:
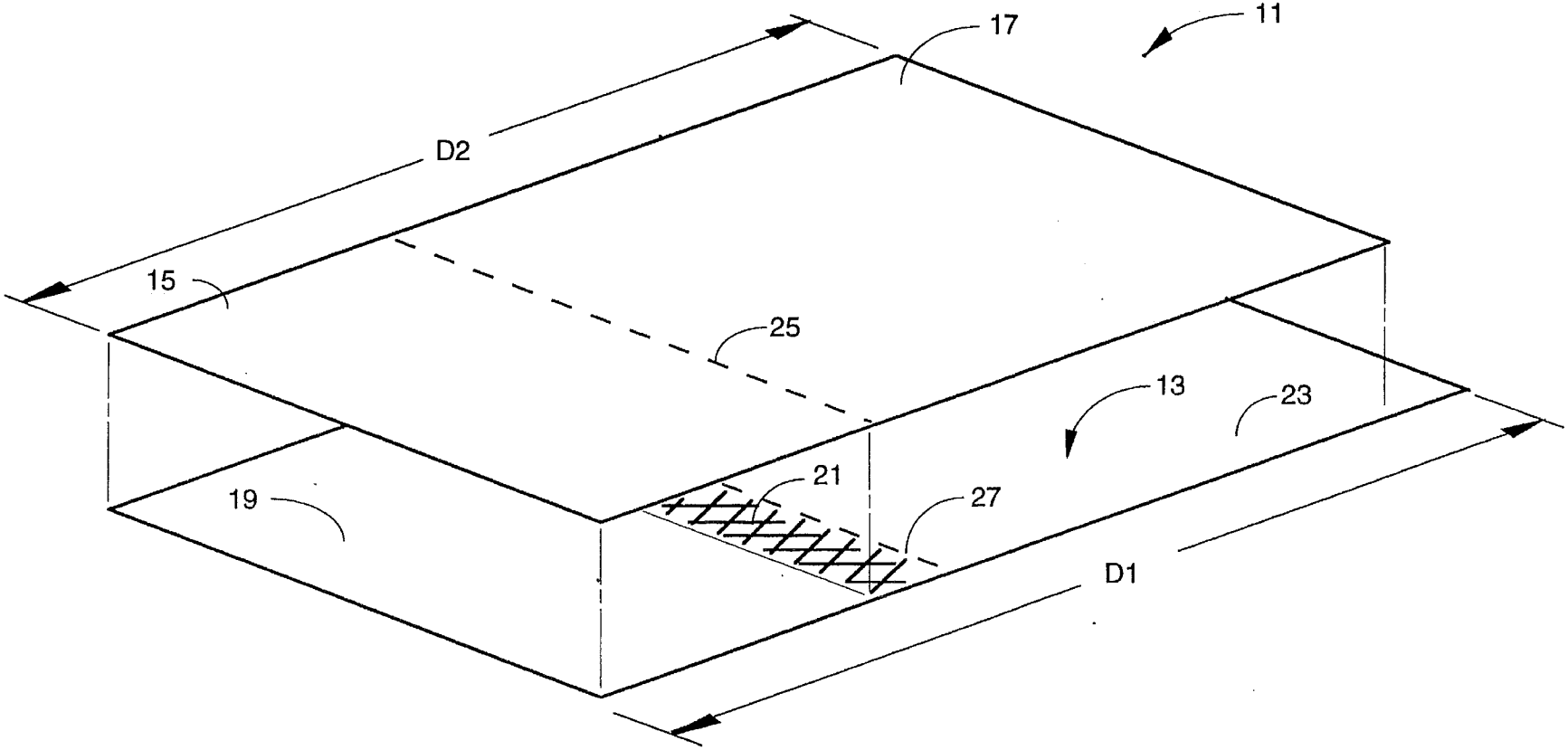
FIG. 1 is an isometric view of two sheets for making a blank for a two-sheet self-mailer according to the invention.

FIG. 1 is an exploded view of two sheets 11 and 13 for forming a blank for folding and gluing into a mailer according to the present invention, showing glue areas and elemental areas for forming various parts of a finished mailer. Both sheets in this embodiment are of 20# white stock. Inside sheet 11 has a perforation line (perf) 25 allowing a "bangtail" portion 17 to be separated from portion 15 which forms the front of a return envelope in a finished mailer according to the invention. Outside sheet 13 has a perf line 27 for separating a backside portion 23 from an area 19 which forms the back of an envelope in a finished mailer according to the invention.

An area 21 adjacent to perf 27 is treated by applying remoistenable glue to form the sealing lip of the return envelope. In the present invention the length D1 of sheet 13 is greater than the length D2 of sheet 11, for reasons that will be made clear in further description below. In one embodiment the length D1 is about 11 inches, and the width of the blank is about 8.5 inches.

Figure 2:
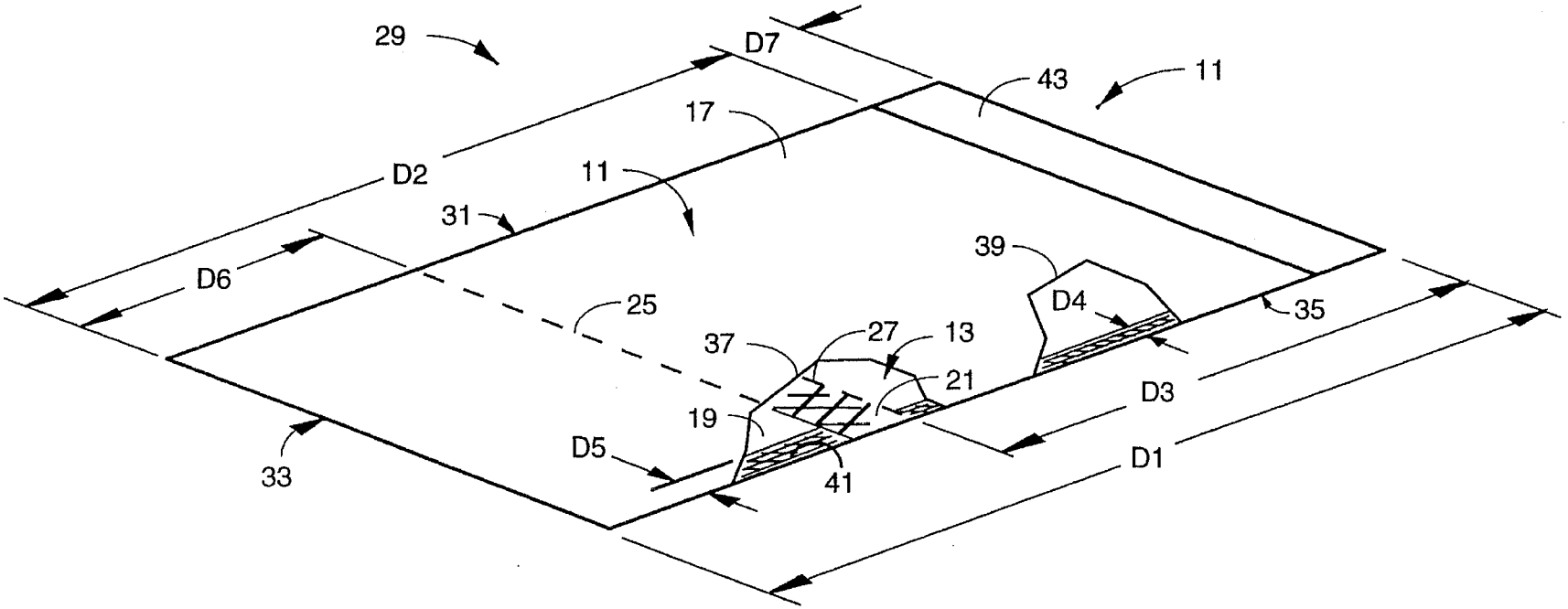
FIG. 2 is an isometric view of a blank formed by the two sheets of FIG. 1.

FIG. 2 shows a blank 29 formed by gluing sheets 11 and 13 together along three sides 31, 33, and 35. Two broken-out sections 37 and 39 through inside sheet 11 allow detail between the sheets to be seen.

Referring to broken-out section 37, perf 27 shows in sheet 13, being the top edge of the return envelope flap when the portions of a mailer are finally separated, and area 21 of remoistenable glue shows, which is the flap area of the return envelope.

Referring to broken-out area 39, back area 23 is shown, and glue strips 41 for adhering the two sheets 11 and 13 together is seen along side 35 as well. Glue strips 41 have a width of D4 along the full length D3 of back area 23, and a width D5 along the height D6 of the envelope formed by areas 15 and 19. D5 is substantially greater than D4, and the necessity for the difference will be apparent in further description below. The other glue strip 41 of dual width is along side 31 of sheets 11 and 13, and another glue strip (not shown) along the bottom side 33 is for closing the lower end of the envelope eventually formed when the mailer is used.

When sheets 11 and 13 are joined to make mailer blank 29, they are joined with the edge of each sheet together at edge 33. Because sheet 11 is shorter than sheet 13, this joining leaves a flap 43 of width D7 at the top of the blank, with an area of back area 23 exposed from the side of inside sheet 11. This flap 43 will be seen in further description to be an important and unique feature of the present invention.

Figure 3:
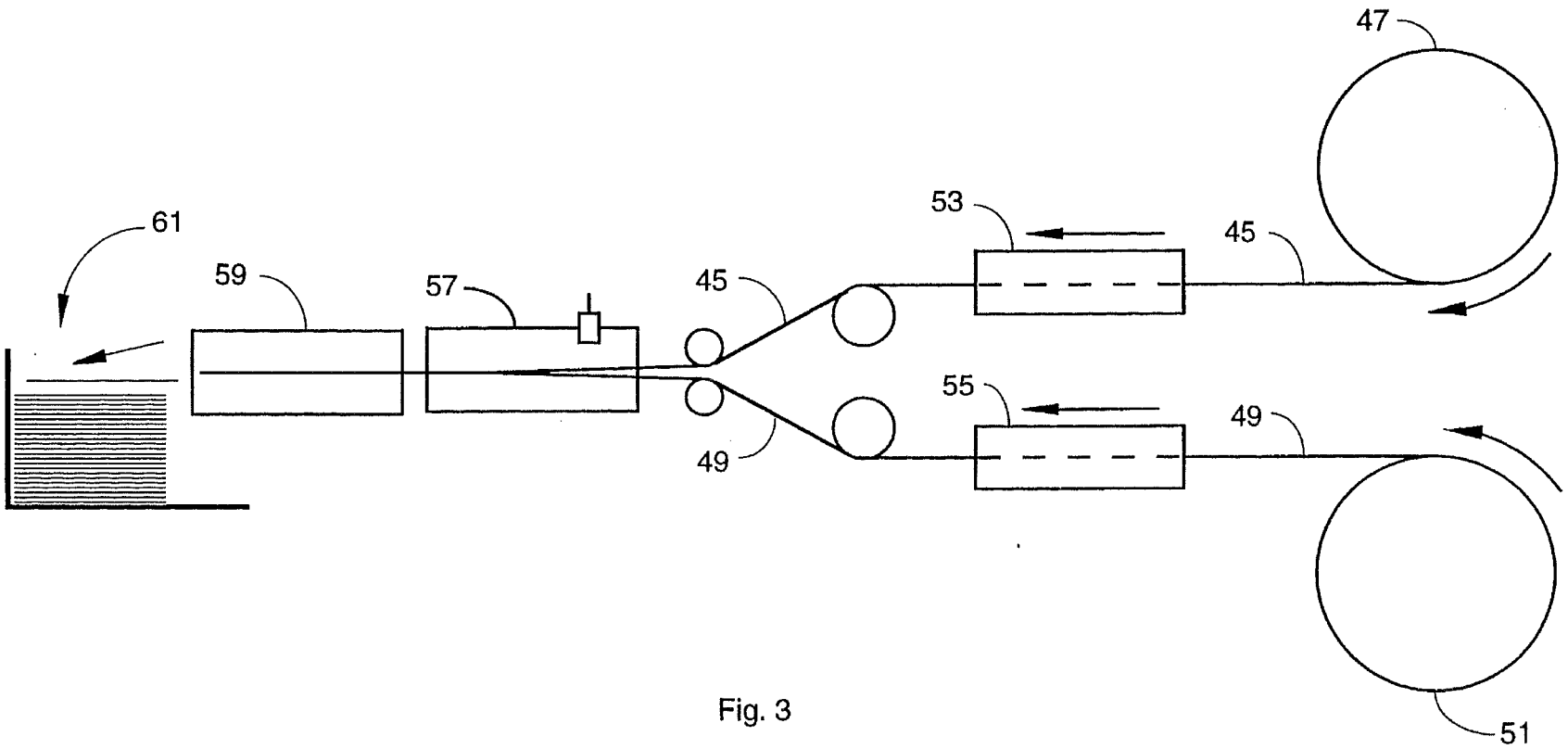
FIG. 3 is a diagrammatical representation of a process flow for making the blanks shown in FIG. 2.

FIG. 3 shows diagrammatically how two webs of paper material may be brought together to make blanks 29 for forming two-sheet self-mailers according to the present invention. FIG. 3 is not meant to represent any particular existing machine or grouping of machines, but merely to represent the functional steps performed. Inside sheets 11 come from web 45 from roll 47. Outside sheets 13 come from a web 49 from roll 51.

A pre-processing module 53 performs optional operations on web 45 prior to the two webs coming together to make blanks for mailers. Module 53 is symbolic, and could be a single machine or a group of machines for performing several operations. An examples of a pre-processing operation is cutting openings at intervals in the web to provide transparent windows for the return envelopes to be formed with the self-mailer. Another example is gluing a small sheet of transparent plastic or paper over the window openings cut, from the side of sheet 11 that is eventually on the inside of the envelope.

Module 55 represents pre-processing for outside sheets 13. An example of pre-processing for outside sheet 13 is application of a strip of remoistenable glue at intervals to form glue areas 21 (FIG. 2) for the return envelope flaps. Cross perfs 25 and 27 may also be cut into the webs before the webs are brought together. These perforations may also be made at other points along the process flow of manufacture.

After pre-processing steps, webs 45 and 49 are brought together at module 57. The glue for glue strips 41 and a cross strip at intervals to glue the webs together to form the bottom of the return envelope (side 33 of FIG. 2) is applied. Sheets 11 are cut at this point and separated along the direction of the web motion by a distance D7 (FIG. 2), which is done before gluing the sheets (or webs) together, because of the difference in length of the sheets.

Cutting web 49 into separate sheets 13 is optional at this point, and typically the final cut is made somewhat later, allowing the glued edges to set. The final cut is made at module 59 and individual blanks 29 are collected at bin 61. It will be apparent to those with skill in the art that there are alternative process flows and operations for forming the sheets 11 and 13 of separate lengths and joining them as shown in FIG. 2 to form separate blanks 29.

The blanks 29 are fed through a laser type printer, typically a Duplex printer, for printing fixed and variable information before folding and gluing to form the self mailer.

Figure 4A:
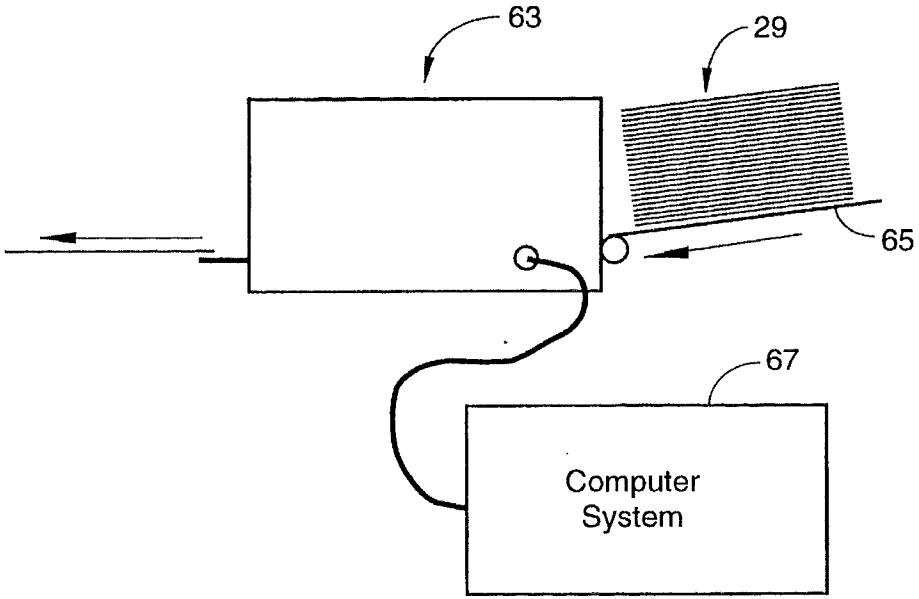
FIG. 4A is an elevation view of a laser fusion printer for printing the blanks of FIG. 2.
Figure 4B:
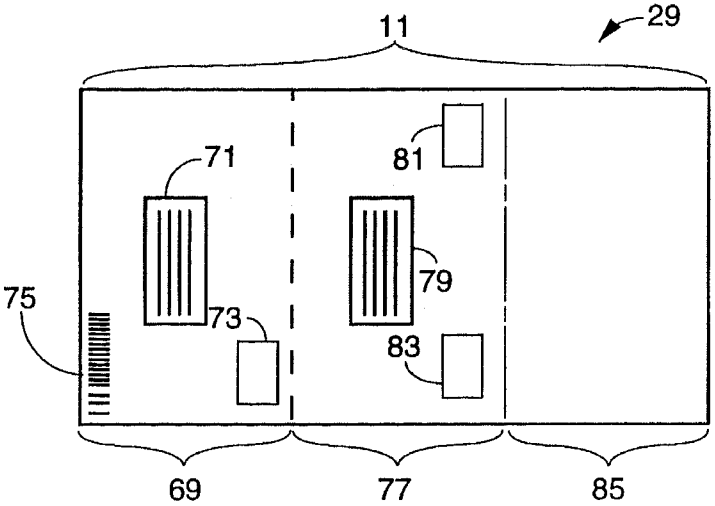
FIG. 4B is a plan view of one side of a printed blank according to the invention.
Figure 4C:
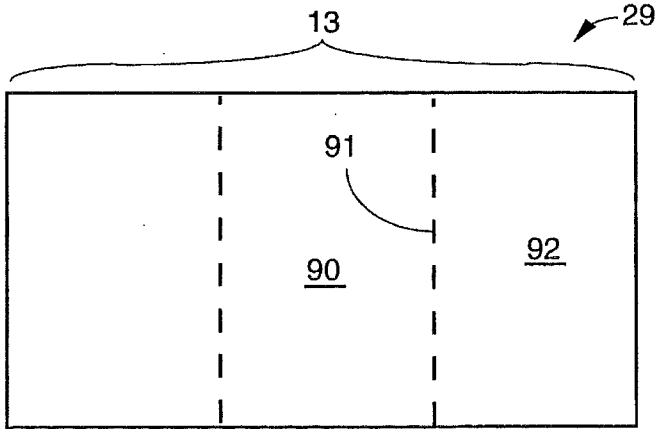
FIG. 4C is a plan view of the other side of the printed blank shown in FIG. 4B.

FIG. 4A illustrates a printer 63 and a stack of blanks 29 in a bin 65 for feeding through the printer. The printer typically prints on both sides of the blanks (duplex), and is controlled by a computer symbolically illustrated at 67. The same printing operation could be performed by running the blanks through a printer twice, at further cost. FIG. 4B and FIG. 4C show both sides of a printed blank 29, and are examples of the kinds of information that may be printed.

The example for FIG. 4B and FIG. 4C is a regular monthly billing application wherein a user provides a statement to the client or customer including a mailer addressed to the customer, a portion to be retained for the customer's records, a portion to be filled in and returned with payment, and an enclosed self-addressed return envelope.

FIG. 4B shows the outside sheet (11) of the two-sheet mailer after printing. On this side information is printed in areas of substantially one third of the total area, divided evenly along the length of the form. The reason for one-third divisions is because in the final operation to be described below, the printed form is folded in two places (three substantially equal areas) and glued to make the mailer.

Area 69 on the side that will be folded to the outside is for the Business Reply address, which becomes the front of the self-addressed return envelope. This includes typically an address 71, which may be the address of the sender, or could be the address of a regional office keyed to the customer's region. There is also a legend 73 "No Postage Necessary etc. . . . ", and the pre-printed Post Net Bar Code 75.

Area 77 is the area that forms the front of a finished mailer after folding and gluing, and is for the address to the customer. It includes the customer's address 79, a return address 81 for the sender, and usually a "Postage Paid" notice 83. Area 85 is folded inside the tri-fold mailer, and has no variable use, but may be used for "boilerplate" information, advertisement, and the like.

FIG. 4C shows sheet 13 of the two-sheet mailer, which is folded to the inside. Area 87 becomes the back of the return envelope, and area 89 is called the "bangtail", upon which is presented the Statement with the variable information particular to the customer, such as payment due date, last payment received, amount owed, and so forth. In this example bangtail 89 is divided into two parts 90 and 92 by a perf 91, so a portion may be retained by the customer and a portion returned. The perf line may be positioned so the two portions of the bangtail are equal or not so. In this example they are equal, and in this case the perf coincides with the fold line for folding the blank into a mailer.

The cross perfs for separating parts of the mailer after the mailer is opened, freeing the bangtail and the return envelope are typically applied to the webs during the making of forms 29 (see FIG. 3). In some cases cross perfs may also be applied during the folding and gluing operation to finish and seal the mailer, described below.

In this process flow, printing is done on the two-sheet blank 29 after the two sheets of the blank are brought together, so necessarily the printing is done on the outside surfaces of the sheets. It will be apparent to those with skill in the art that some printing could be done on the webs before joining in the process flow illustrated by FIG. 3. This pre-printing is not the preferred mode, however, for several reasons. One reason is that typically the blanks are made and supplied to end users who do their own printing and folding and gluing into mailers. This procedure allows the end users to handle a maximum amount of variable information. Operation of a duplex printer from a computer using a program accessing a database allows individual addressing of mailers, different return addresses, inclusion of billing information differing on every form, and the like.

Figure 5:
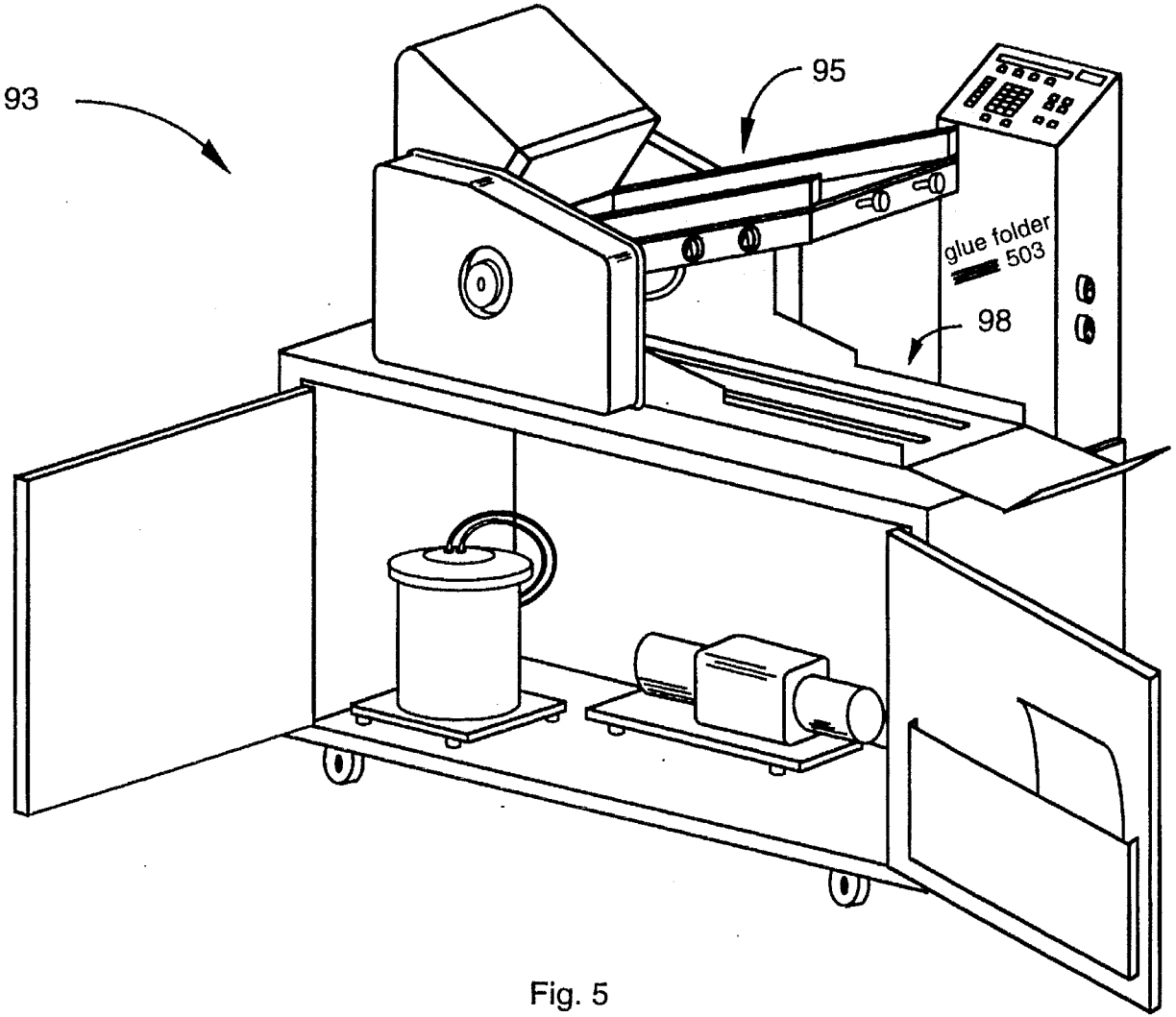
FIG. 5 is an isometric view of a folding, perfing, and gluing machine for forming mailers from blanks according to the invention.

FIG. 5 is an isometric view of a form folding and gluing machine 93 known as the Model 503 GlueFolder, marketed by GlueFold Corporation of Newark, Calif. In the preferred embodiment this machine is the machine used to fold, perf, and glue blanks 29 into self-mailers, although perhaps other machines could be adapted to use.

In GlueFolder 93 blanks 29 are placed in bin 95 "address face down". That is, the sheet (13) of the two-sheet blank 29 having the client's address in the center area 77 (see FIG. 4B) is placed down. This may not be so in other folding and gluing machines not illustrated here. The two-sheet blanks are fed one-at-a-time at rates as high as 20,000 blanks per hour through the Glue Folder, folding the blank into a letter-size mailer with the customer's address (area 77 of FIG. 4B) on the outside, expelling folded and glued mailers onto a takeaway conveyor 98.

Figure 6:
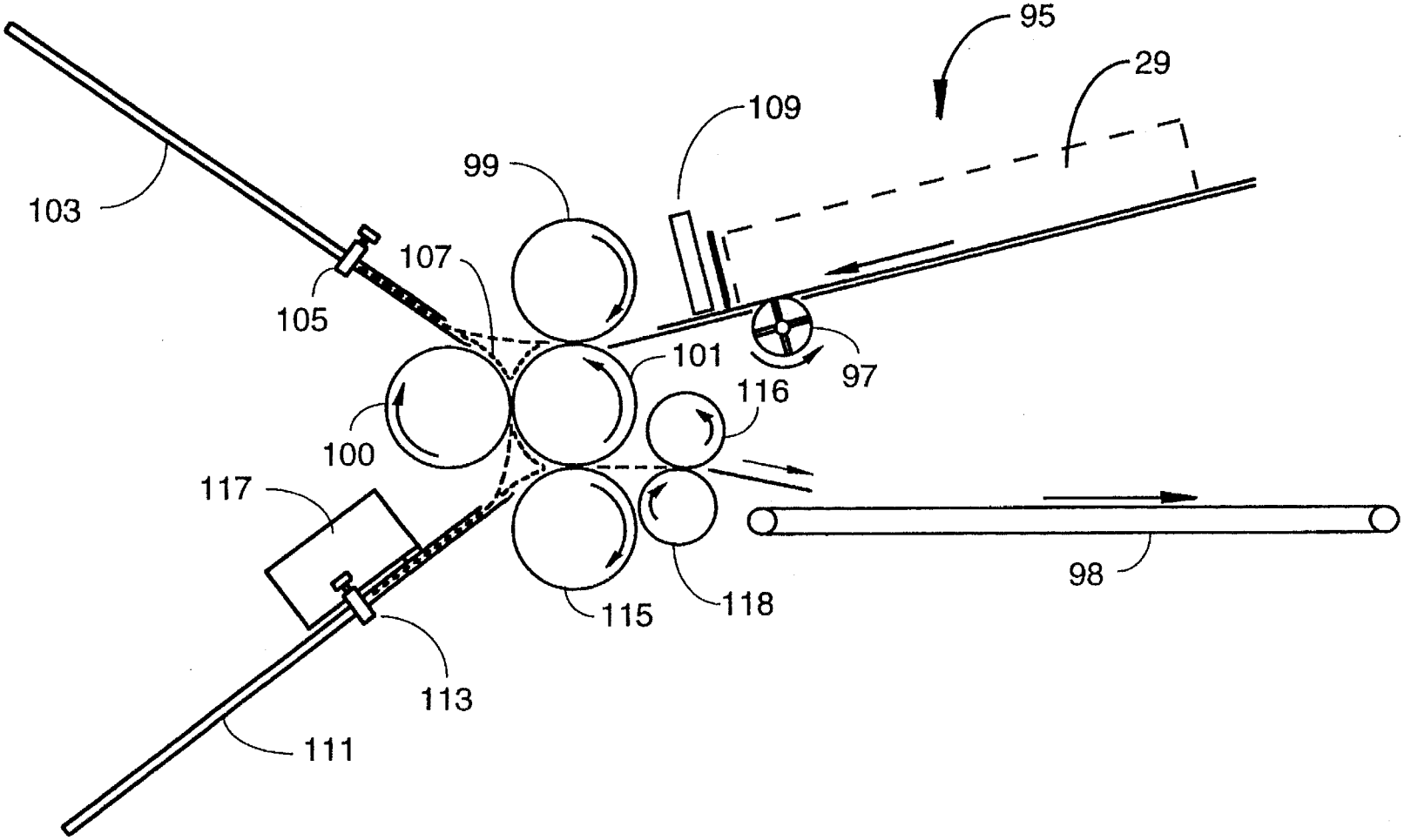
FIG. 6 is a diagrammatical view of the folding, gluing, and perfing mechanisms of the machine shown in FIG. 5, showing the path of a blank through the machine.

FIG. 6 illustrates the folder, perforator, and positions of glue application in GlueFolder 93. Blanks 29 stacked address side down in bin 95 are fed one-at-a-time by wheel 97 into rollers 99 and 101 which rotate to drive the blank onto folding plate 103. As each blank passes a pair of glue applicators 109 a water-miscible air-drying glue is applied along the edges of the "upside" of the blank, which is the side to be folded to the inside of the mailer. This is sheet 13 opposite the "address" side, which is placed down.

Glue is applied in a glue line along each edge of the blank as the blank passes the applicators. The glue lines are applied generally within one-eighth inch of the edge of the blank, although this dimension is somewhat variable, and it is not necessary for the glue lines to extend the full length of the blank. Typically the glue lines are applied only along the length of the edges of area 89 (FIG. 4C). Rollers 99 and 101 have grooves allowing clearance for the glue lines as the blanks pass through the rollers.

After a portion of the blank passes through rollers 99 and 101, the blank hits a stop 105 which, because rollers 99 and 101 continue to drive, causes the blank to buckle (dotted line 107) into rollers 100 and 101, making the first fold, and to be drawn through these rollers onto second folding plate 111.

As rollers 100 and 101 continue to drive the blank, the first fold line hits a stop 113 on the second folding plate, and the blank begins to buckle into rollers 115 and 101 to make the second fold. The part of the blank that strikes stop 113 is the area at the top of the address side of the business reply envelope. At this position, several dots of glue are applied from applicators 117 positioned at the second stop, and these dots are placed across the width of the blank. The position of the glue dots is along the top of area 69, the address front of the business reply envelope.

As the once-folded blank passes through rollers 115 and 101, the final fold is made, the sides of area 92 (FIG. 4C) are glued to the sides of area 69, and end flap 43 (FIG. 2) is glued to the top edge of area 69, finishing the folding and gluing operations for the mailer.

After the mailer passes through rollers 115 and 101, it then passes through perf rollers 116 and 118 for making perforations along the outer edges to facilitate opening the mailer, and is deposited on take-away conveyor 98. These perf lines are made through all of the layers of the folded mailer at a distance from the edge greater than D4 (FIG. 2), but less than D5. So the perf lines run through glue lines 41 along the edges of the return envelope, but to the inside of glue lines 41 along the length of the bangtail. This spacing allows the edges of the return envelope to remain together when the edges of the mailer are torn off along the edge perf lines, and at the same time releases the bangtail along the edges.

FIGS. 7A through 7H illustrate the several stages of a blank 29 passing through the GlueFolder, to illustrate more clearly how the folding, gluing and perfing is accomplished, and the nature of the mailer that results.

Figure 7C:
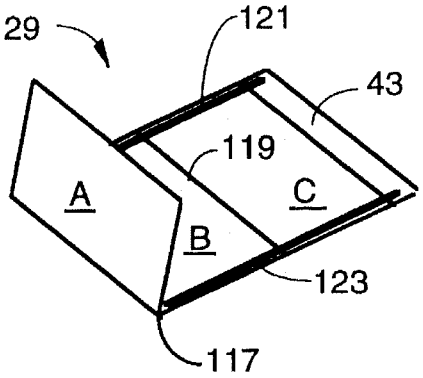
FIG. 7C shows the blank with the first fold partially developed.
Figure 7B:
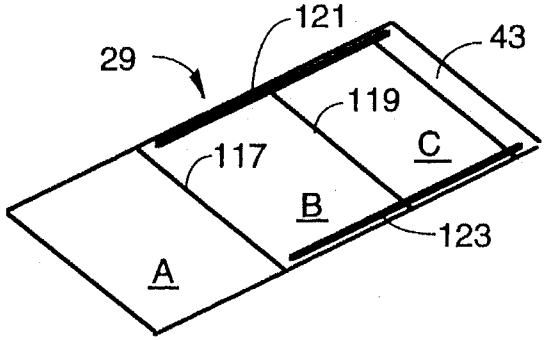
FIG. 7B shows the blank of FIG. 7A after passing the first gluing station.
Figure 7A:
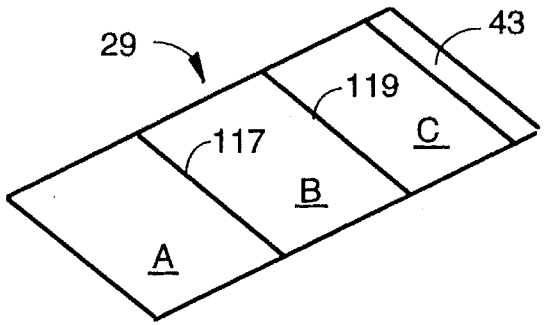
FIG. 7A shows a blank starting through the process flow of FIG. 6.

FIG. 7A shows a blank 29 placed address side down with flap 43 at one end. Flap 43, as described above, is a result of one of the two sheets joined to form the blank being shorter than the other. Lines 117 and 119 indicate the lines along which the blank will be folded by the GlueFolder, dividing the blank into three substantially equal area portions A, B, and C, each being in length about one-third of the length of the blank (D1 in FIG. 2).

FIG. 7B shows the situation after the blank passes through the edge glue applicators 109 (FIG. 6). Glue lines 121 and 123 have been applied along the edges of the blank from fold line 117 through portions B and C to the flap end.

Figure 7E:
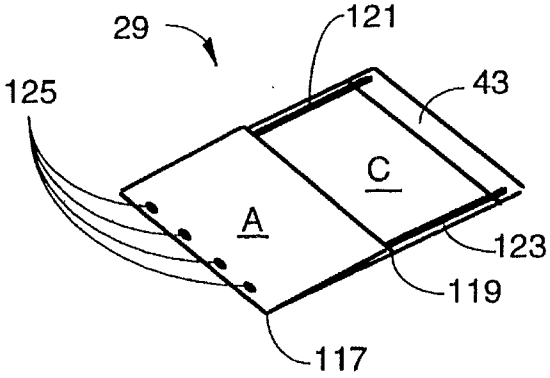
FIG. 7E shows the blank after applying glue dots across the width of the blank.
Figure 7D:
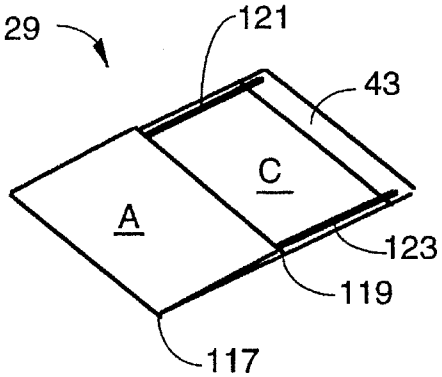
FIG. 7D shows the blank after the first fold is completed.

FIG. 7C shows leading A area partially folded over center area B along fold line 117. FIG. 7D shows the first fold completed. Leading area A adheres to center area B along the edges by virtue of glue lines 121 and 123 on area B.

FIG. 7D shows the first fold completed. FIG. 7E shows glue dots 125 (four in this example) applied along the first fold, as described above, when the once-folded blank contacts stop 113 on fold plate 111 (FIG. 6).

Figure 7G:
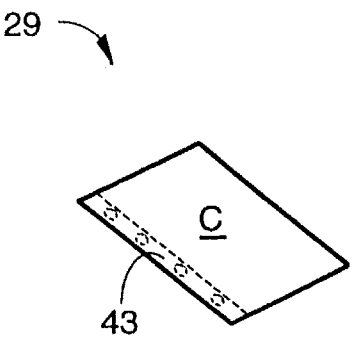
FIG. 7G shows the blank after the second fold is completed.
Figure 7F:
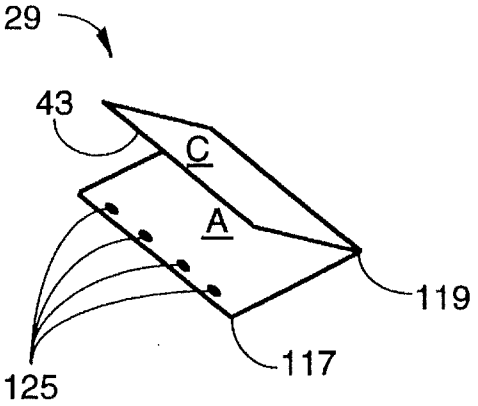
FIG. 7F shows the blank with the second fold partially developed.

FIG. 7F shows the last fold partially completed. Flap 43 is an extension of sheet 13, the address side of the blank, and FIG. 7G shows the last fold completed, with flap 43 adhered to the four glue dots.

Figure 7H:
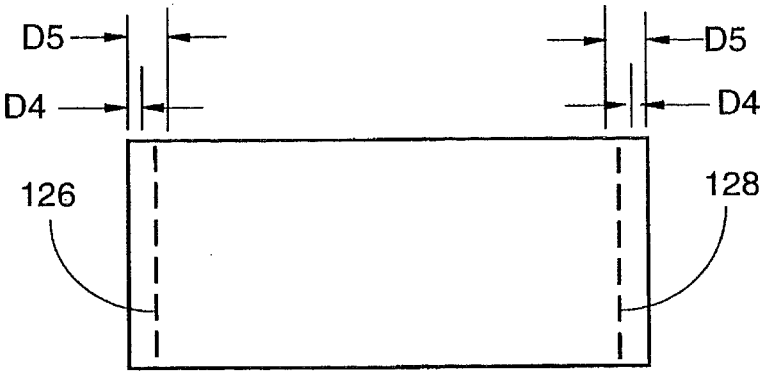
FIG. 7H shows the blank after edge perfs are applied, finishing the mailer.

FIG. 7H shows the finished mailer with edge perfs 126 and 128 made. The widths D4 and D5 at each edge are shown as well, to illustrate the positioning of the perf lines from the edges.

The importance of flap 43 and the gluing of the flap to the edge of the first fold may be best illustrated by showing what would be the case if the two sheets to make the mailer (11 and 13) were of the same length, and there were no flap, as is the case in mailers in the prior art. This situation is shown in FIGS. 8A and B.

Figure 8B:
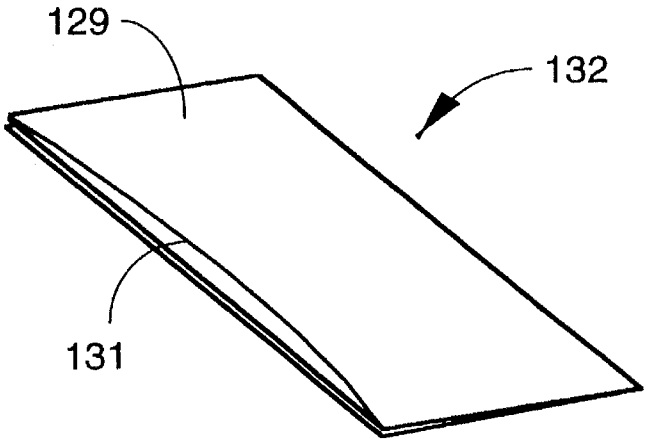
Fig. 8B PRIOR ART
FIG. 8B shoes the prior art blank of FIG. 8A with the second fold completed, illustrating the loose edge that results.
Figure 8A:
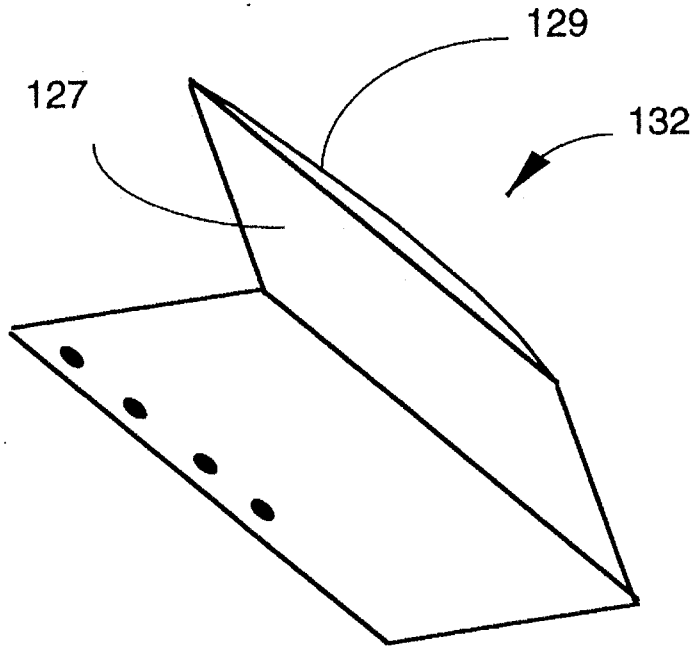
Fig. 8A PRIOR ART
FIG. 8A shows a prior art blank with a second fold partially completed.

FIG. 8A shows a prior art two-sheet mailer 132 with no flap, with the last fold in progress. Inside surface 127 is the surface that comes in contact with glue dots, and is therefore the surface that adheres to the surface with the glue dots. This leaves surface 129 free. This situation after finishing the mailer is shown in FIG. 8B. Loose edge 131 renders the prior art mailer unfit to be handled by automatic machinery, and it will not meet the requirements for the Post Net Bar Code handling.

There are alternatives to this situation in the prior art that would allow the mailer to be automatically handled. One is to glue the two sheets that make the blank together along edge 131 when the two sheets are joined to make the blank. Then edge 131 would not be loose even though there is no flap as in the present invention. The problem in this case is that there will be no loose edge to release the statement portion of the form to the client; what the inventors call the bangtail.

Figure 9B:
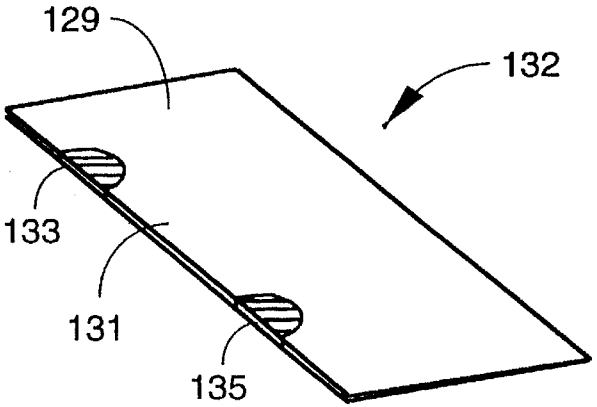
Fig. 9B PRIOR ART
FIG. 9B shows the mailer of FIG. 9A with the tabs applied to close the loose edge.
Figure 9A:
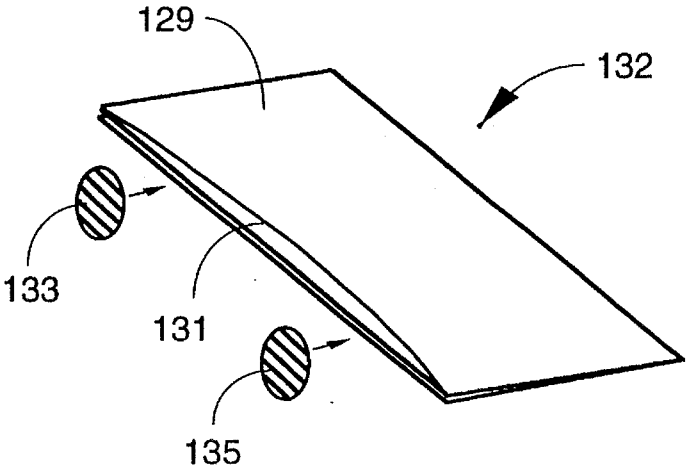
Fig. 9A PRIOR ART
FIG. 9A shows the prior art mailer of FIG. 8B with two stick-on tabs positioned to be applied to close the loose edge.

Another alternative in the prior art is what is called tabbing. FIG. 9A shows the finished prior art mailer of FIG. 8B and two round paper tabs 133 and 135 having adhesive on one side. FIG. 9B shows tabs 133 and 135 folded over and adhered to edge 131 to close the loose edge, and render the mailer fit to be handled with automatic equipment. The tabs are added by a tabbing machine developed for this purpose, and this solution adds extra material and operations, therefore added expense.

Figure 10B:
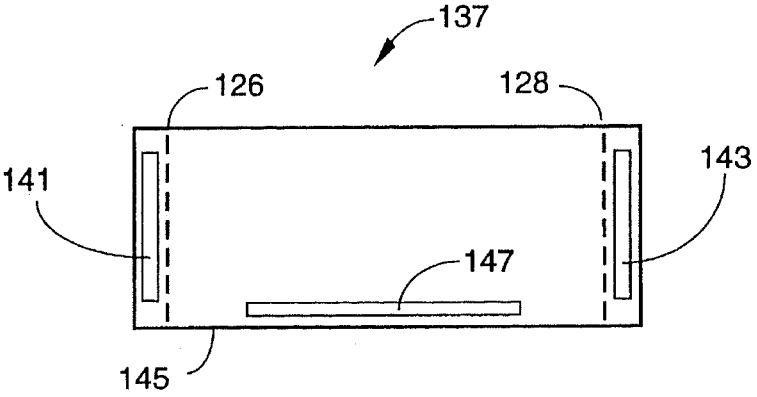
FIG. 10B shows the mailer of FIG. 10A turned over to be opened.
Figure 10D:
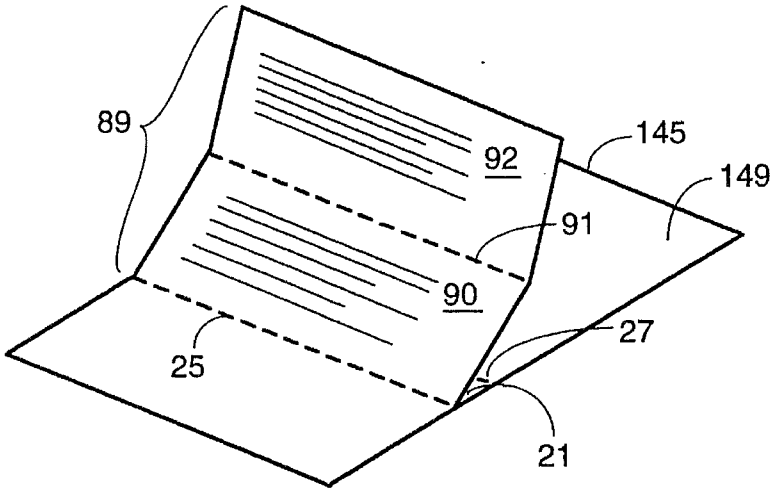
FIG. 10D shows the mailer according to the invention fully opened with the bangtail presented loose on three sides.
Figure 10A:
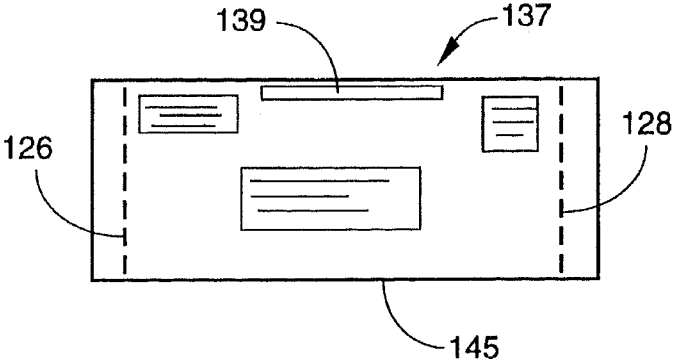
FIG. 10A shows a mailer according to the present invention with the address side up.

FIGS. 10A through 10D show the stages of opening a mailer 137 according to the present invention. FIG. 10A shows the mailer as seen by a recipient before opening, with the recipient's address forward and edge perfs 126 and 128. The bottom edge 145; which is the glued edge, is down. The preferred method for opening the mailer is from the backside. Accordingly there is typically a notice 139 on the address side to the effect "TO OPEN SEE INSTRUCTIONS ON BACK SIDE".

FIG. 10B shows mailer 137 turned over horizontally so glued edge 145 (flap 43) is at the bottom. There are typically printed notices 141 and 143 along each tear-off edge: "FOLD AND TEAR HERE". Often arrows accompany the notices pointing at the perf lines 126 and 128. Another notice 147 "SLIDE FINGER UNDER EDGE TO OPEN" appears along edge 145.

Figure 10C:
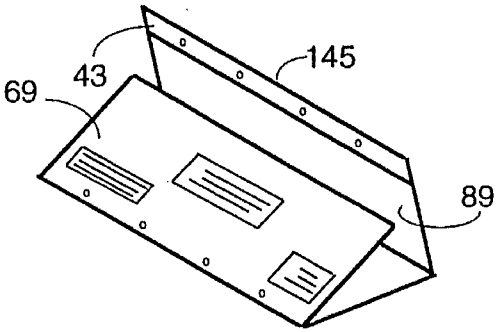
FIG. 10C shows the mailer of FIG. 10B with the edges removed along the edge perf lines, and the mailer partially opened.

FIG. 10C shows the mailer after the edges are snapped off along the perfs, and edge 145 with the glue spots is released. The mailer is shown partially unfolded. The address surface of the business reply envelope is seen on the inside with the address upside down. This is area 69 of FIG. 4B. Flap 43 is shown at the top inside along edge 145, and the bangtail (89 of FIG. 4C), is seen to be loose along the flap edge and the sides.

FIG. 10D shows the mailer completely unfolded. Bangtail 89 is free, except for perf line 25 at the top edge of the back of business reply envelope. Cross perf line 25 is through only the single sheet of which the bangtail is a part, which is sheet 11 in FIG. 2. As previously described, the cross perfs are preferably added in the process of making the blanks 29 before the two sheets (11 and 13) that make the blank are joined. In alternative embodiments of the invention, however, cross perfs may be added by lateral perf knives on rollers of the Glue Fold machine. In this case the depth of the cut is adjusted to perf only one of the two sheets of the blank.

The advantageous situation of the semi-free bangtail only accrues with a mailer according to the present invention, and is a result of the presence of the flap. The top of the bangtail does not get glued down by the glue dots as is the case in prior art mailers. As a result, the bangtail is free at the top and sides, and tearing it off along perf line 25 is intuitive.

In the unfolded state of FIG. 10D, perf 27 is seen at the top of the business reply envelope, and area 21 of remoistenable glue, which is the sealing flap of the business reply envelope. From FIG. 10D one merely tears the bangtail off along perf 25, separates the two parts (if there are two parts) along perf 91 (see FIG. 4C), and frees the business reply envelope by tearing along perf 27. Portion 149, which includes the original address of the recipient on the opposite side, may be discarded.

It will be apparent to those with skill in the art that there are many alterations that may be made without departing from the spirit and scope of the invention. For example, mailers of many different sizes may be made, and from various weights of paper stock. The size of a standard business envelope is convenient. The widths (D4 and D5) of glue strips to join sheets to make the two sheet mailer are somewhat arbitrary, within the limit of the edge perfs being placed greater than D4 but less than D5. There are similarly many other alterations in detail that might be made without departing from the spirit and scope of the invention.

What is claimed is:

1. A blank for forming a self-mailer by folding, perforating, and gluing, the blank comprising:

a first substantially rectangular sheet of paper stock having a width W and a length D1;

a second substantially rectangular sheet of paper stock having width W and a length D2 greater than length D1 by less than one third of D2, the second sheet of paper stock substantially aligned with and joined evenly by adhesive regions at one end and along the two lengthwise edges to the first sheet of paper stock, the joined sheets having adjacent inside facing surfaces with an extended portion of the second sheet of paper stock extending at the unjoined end beyond the first sheet of paper stock, the extended portion providing for gluing a portion of the inside facing surface of the second sheet to an outside facing surface of one of the first and second sheets after folding; and a remoistenable glue strip on the inside facing surface of one of the sheets of paper stock, the remoistenable glue strip extending across substantially width W, beginning at a position about one-third of length D2 from the evenly joined end and extending in lengthwise direction away from the evenly joined end by a dimension less than one-third of length D2, the remoistenable glue strip for providing a sealable flap for a return envelope.

2. A blank for a self-mailer as in claim 1 wherein the remoistenable glue strip is on the inside facing surface of the second sheet of paper stock.

3. A blank for a self-mailer as in claim 2 wherein the adhesive region along each lengthwise edge between the inside-facing surfaces has a first widthwise dimension over a first lengthwise portion and a second widthwise dimension less than the first widthwise dimension over the remaining lengthwise portion, the first lengthwise portion extending from about the evenly joined end to about the remoistenable glue strip, and the remaining lengthwise portion extending from about the remoistenable glue strip away from the evenly joined end to about length D1.

4. A blank for a self-mailer as in claim 1 wherein width W is about 8.5 inches and length D2 is about 11 inches.

5. A two-sheet self-mailer comprising:

a first substantially rectangular sheet of paper stock having a width W and a length D1;

a second substantially rectangular sheet of paper stock having width W and a length D2 greater than length D1 by less than one third of the length D2, the second sheet of paper stock substantially aligned with and joined evenly by adhesive regions at one end and along the two lengthwise edges to the first sheet of paper stock, the joined sheets having adjacent inside facing surfaces with a portion of the second sheet of paper stock extending at the unjoined end beyond the first sheet of paper stock; and a remoistenable glue strip on the inside facing surface of one of the sheets of paper stock, the remoistenable glue strip extending across substantially width W, beginning at a position about one-third of length D2 from the evenly joined end and extending in lengthwise direction away from the evenly joined end by a dimension less than one-third of length D2;

the two joined sheets of paper stock folded twice enclosing the first sheet of paper stock, a first fold along a first widthwise fold line positioned about one-third of length D2 from the evenly joined end, and a second fold along a second widthwise fold line positioned at about two-thirds of length D2 from the evenly joined end, the second fold enclosing the evenly joined end, with the extended portion of the second sheet of paper stock folded across width W in the direction of the first two folds, and the inside-facing surface of the extended portion joined by adhesive to the outside facing surface of the second sheet.

6. A two-sheet self-mailer as in claim 5 wherein the remoistenable glue strip is on the inside facing surface of the second sheet of paper stock.

7. A two-sheet self-mailer as in claim 6 wherein the adhesive region along each lengthwise edge between the inside-facing surfaces has a first widthwise dimension over a first lengthwise portion and a second widthwise dimension less than the first widthwise dimension over the remaining lengthwise portion, the first lengthwise portion extending from about the evenly joined end to about the remoistenable glue strip, and the remaining lengthwise portion extending from about the remoistenable glue strip away from the evenly joined end to about length D2.

8. A two-sheet self-mailer as in claim 5 wherein width W is about 8.5 inches and length D2 is about 11 inches.

* * * * *